United States Patent [19]

Karasin et al.

[11] Patent Number: 4,878,774

[45] Date of Patent: Nov. 7, 1989

[54] VALVED DISPENSING APPLICATOR

[75] Inventors: Craig E. Karasin, Orangetown, N.Y.; Joseph Thompson, Upper Saddle River, N.J.

[73] Assignee: Sterling Drug Inc., Rensselaer, N.Y.

[21] Appl. No.: 84,571

[22] Filed: Aug. 12, 1987

[51] Int. Cl.[4] ..... B05C 17/00

[52] U.S. Cl. ..... 401/15; 401/152; 401/267; 222/153; 222/521; 222/524

[58] Field of Search ..... 401/263, 267, 15, 277, 401/152, 156, 265, 266, 261; 222/519, 520, 521, 522, 525, 523, 153, 96, 151, 212, 481, 499, 489, 524, 559; 215/217, 201, 202, 216, 218

[56] References Cited

U.S. PATENT DOCUMENTS

| | | | |
|---|---|---|---|
| 1,083,552 | 1/1914 | McCord | 222/524 |
| 1,568,657 | 1/1926 | Coe . | |
| 1,621,567 | 3/1927 | Van Sant . | |
| 1,841,012 | 1/1932 | Daniels | 401/266 |
| 2,153,426 | 4/1939 | McNamara et al. . | |
| 2,253,779 | 8/1941 | Gutierrez | 401/15 |
| 2,716,250 | 8/1955 | Deakers . | |
| 2,889,081 | 6/1959 | Spencer . | |
| 3,157,323 | 11/1964 | Kitterman . | |
| 3,229,866 | 1/1966 | Arbitman et al. . | |
| 3,262,613 | 7/1966 | Miller | 222/522 |
| 3,276,640 | 10/1966 | Kessler . | |
| 3,294,293 | 12/1966 | Johns . | |
| 3,422,978 | 1/1969 | Quackenbush . | |
| 3,429,653 | 2/1969 | Brett . | |
| 3,468,611 | 9/1969 | Ward . | |
| 3,578,223 | 5/1971 | Armour | 222/521 |
| 3,690,520 | 9/1972 | Sarris | 222/499 |
| 3,717,287 | 2/1973 | Marand . | |
| 3,794,090 | 2/1974 | Commisso . | |
| 3,834,596 | 9/1974 | Brady et al. | 222/520 |
| 3,844,455 | 10/1974 | Stull . | |
| 3,847,299 | 11/1974 | Page . | |
| 3,915,577 | 10/1975 | Cropton . | |
| 3,954,200 | 5/1976 | Willis . | |
| 3,977,557 | 8/1976 | Hazard . | |
| 3,999,680 | 12/1976 | Chu . | |
| 4,020,981 | 5/1977 | Nixdorff . | |
| 4,065,037 | 12/1977 | Haller . | |
| 4,162,010 | 7/1979 | Hovsepian . | |
| 4,209,100 | 6/1980 | Uhlig . | |
| 4,220,262 | 9/1980 | Uhlig et al. . | |
| 4,236,653 | 12/1980 | Gach . | |
| 4,261,487 | 4/1981 | Seager | 222/520 |
| 4,279,527 | 7/1981 | Moe et al. . | |
| 4,281,778 | 8/1981 | Stull . | |
| 4,345,691 | 8/1982 | Burke . | |
| 4,358,031 | 11/1982 | Lohrman . | |
| 4,366,921 | 1/1983 | Kirk, Jr. . | |
| 4,383,623 | 5/1983 | Page, III . | |
| 4,390,113 | 1/1983 | Bird . | |
| 4,447,169 | 5/1984 | Vartoughian . | |
| 4,464,316 | 8/1984 | Michaels | 215/218 X |
| 4,474,314 | 10/1984 | Roggenburg, Jr. | 222/521 X |
| 4,533,058 | 8/1985 | Uhlig . | |
| 4,550,862 | 11/1985 | Barker et al. . | |
| 4,576,309 | 3/1986 | Tzifkansky et al. . | |
| 4,605,135 | 8/1986 | Ryder . | |
| 4,690,304 | 9/1987 | Morel | 222/521 X |

*Primary Examiner*—Richard J. Apley
*Assistant Examiner*—David J. Bender
*Attorney, Agent, or Firm*—Wenderoth, Lind & Ponack

[57] ABSTRACT

A dispenser including a container body, a mounting member fitted on the container body and a dispensing head such as an applicator head movably mounted on the mounting member. The mounting member includes an axially extending closure member with a pin member thereon. The dispensing head includes an aperture and an axially extending wall forming a skirted chamber beneath the aperture, the skirted chamber including slits at least one opening through the wall for controlling flow of material from outside the wall, through the opening and into the skirted chamber from the container body. The dispensing head is movable from an open position to a closed position wherein the closure member fits within the skirted chamber and the pin member fits within the aperture.

19 Claims, 7 Drawing Sheets

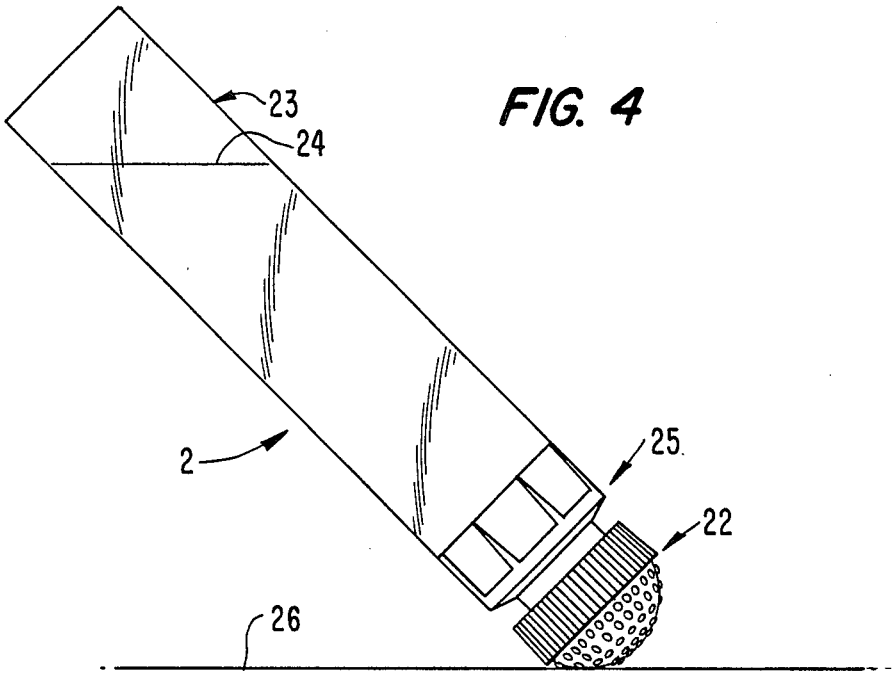
FIG. 4
FIG. 5
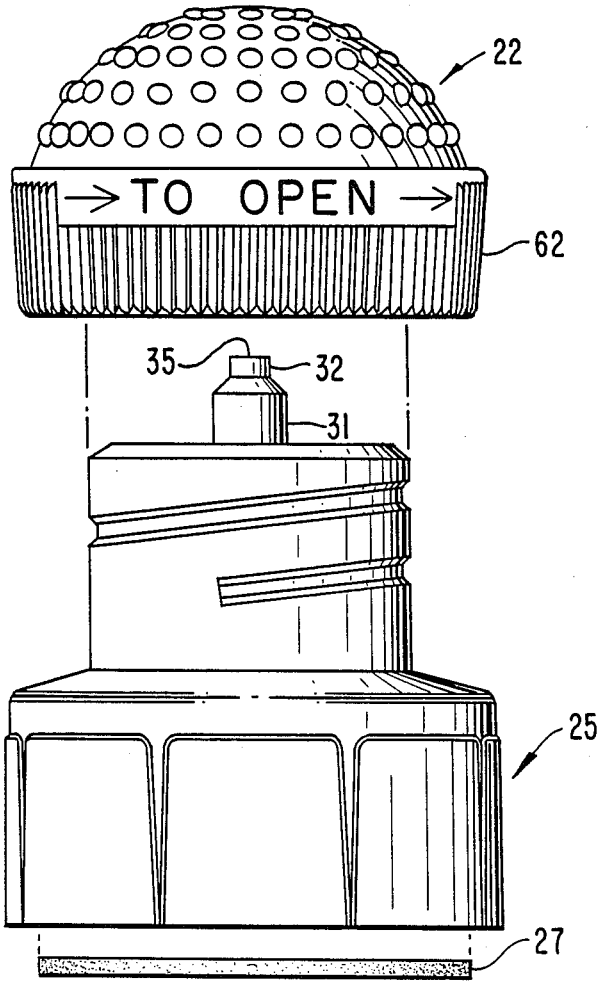

VALVED DISPENSING APPLICATOR

BACKGROUND OF THE INVENTION

1. Field of the Invention

The present invention relates to a dispenser having a dispensing head, particularly a dispenser including an applicator head, a squeezable container body for application of a flowable liquid through the applicator head, and a vented package for holding a plurality of the dispensers.

2. Background of the Invention

Various two piece closures are known in the art wherein one member includes an axially extending pin and the other member includes an aperture aligned with the pin and a skirted chamber surrounding the pin. Such two piece closures are disclosed by Kitterman (U.S. Pat. No. 3,157,323), Kessler (U.S. Pat. No. 3,276,640), Nixdorff (U.S. Pat. No. 4,020,981) and Page, III (U.S. Pat. No. 4,383,623). Manufacturers of such devices include Calmar Dispensing Systems of Watchung, N.J. which makes a Modified Calmar Auto Cap, U.S. Cap of Saddle Brook, N.J. which makes a Push-Pull Cap, Product Design and Engineering, Inc. of Minneapolis, Minn., Gibson Associates, Inc. of Cranford, N.J., Stull Engraving Company of Garfield, N.J. and Seaquist Closures of Crystal Lake, Ill.

Various dispensers having applicators extending therefrom are known in the art. Such dispensers include those taught by Vartoughian (U.S. Pat. No. 4,447,169), Cropton (U.S. Pat. No. 3,915,577), Deakers (U.S. Pat. No. 2,716,250), Ward (U.S. Pat. No. 3,468,611), Van Sant (U.S. Pat. No. 1,621,567), Stull (U.S. Pat. No. 3,844,455), Moe et al. (U.S. Pat. No. 4,279,527) and Arbitman et al. (U.S. Pat. No. 3,229,866). Each of the dispensers disclosed in these patents differs from that of the present invention in one or more ways.

Various vented packages are known in the art, such packages including those taught by Brett (U.S. Pat. No. 3,429,653), Page et al. (U.S. Pat. No. 3,847,299), Commisso (U.S. Pat. No. 3,794,090) and Bird (U.S. Pat. No. 4,390,113). Other vented containers include those taught by Chu (U.S. Pat. No. 3,999,680) and Tzifkansky et al. (U.S. Pat. No. 4,576,309). Hovsepian (U.S. Pat. No. 4,162,010) teaches a container body having recesses distributed around an open top thereof. Each of the containers disclosed in these patents differs from the vented package of the present invention in one or more ways.

Containers having ratchet means to prevent unintentional removal of the closures thereof are well known in the art and are exemplified by the patents to Burke (U.S. Pat. No. 4,345,691), Willis (U.S. Pat. No. 3,954,200), Coe (U.S. Pat. No. 1,568,657), McNamara et al. (U.S. Pat. No. 2,153,426), Spencer (U.S. Pat. No. 2,889,081), Johns (U.S. Pat. No. 3,294,293), Quackenbush (U.S. Pat. No. 3,422,978), Marand (U.S. Pat. No. 3,717,287), Hazard (U.S. Pat. No. 3,977,557), Haller (U.S. Pat. No. 4,065,037), Uhlig (U.S. Pat. Nos. 4,209,100 and 4,533,058), Gach (U.S. Pat. No. 4,236,653), Stull (U.S. Pat. No. 4,281,778), Lohrman (U.S. Pat. No. 4,358,031), Kirk, Jr. (U.S. Pat. No. 4,366,921), Uhlig et al. (U.S. Pat. No. 4,220,262), Barker et al. (U.S. Pat. No. 4,550,862) and Ryder (U.S. Pat. No. 4,605,135).

SUMMARY OF THE INVENTION

The present invention is directed to a vented package.

The present invention is directed to a dispenser comprising a container body, particularly a squeezable bottle, a mounting member fitted on one end of the container body, the mounting member having a flow passage therethrough in fluid communication with an opening in the container body, the mounting member including a closure member extending in an axial direction, and a dispensing head movably mounted on the mounting member, the dispensing head being movable in the axial direction towards the mounting member to a closed position and movable in the axial direction away from the mounting member to an open position and having at least one aperture therein for dispensing a flowable substance stored in the container body, the closure member including aperture sealing means for sealing the at least one aperture when the dispensing head is moved to the closed position, the dispensing head further including a skirted chamber in fluid communication with the at least one aperture, the skirted chamber being defined by a radially inner surface of an axially extending wall of the dispensing head, the inner surface sealingly engaging the closure member when the dispensing head is in the open and closed positions, the skirted chamber including means for controlling flow of the flowable substance from the flow passage of the mounting member into the skirted chamber so that excess dripping of the flowable substance from the dispensing head is avoided during use thereof.

In a preferred embodiment the dispensing head is in the form of an applicator head, the applicator head having applicator means thereon for distributing a flowable substance stored in the container body over an article to which the flowable substance is to be applied. Also, the closure member can have a pin member thereon extending in the axial direction away from the container body. In this case, the applicator head includes a single aperture sized for sealingly engaging the pin member when the applicator head is in the closed position.

Other features of the present invention include a hemispherical shaped axial end surface forming part of the applicator head and a plurality of projections on the hemispherical surface comprising the applicator means. The mounting member includes a tubular portion extending in the axial direction with the closure member being disposed radially inward of an inner surface of the tubular portion, the dispensing head including means thereon for sealingly engaging the inner surface of the tubular portion when the dispensing head is in any position between and including the open and closed positions. The dispensing head also includes means for sealingly engaging an outer surface of the tubular portion when the dispensing head is in any position between and including the open and closed positions.

The flow control means of the present invention comprises at least one slit extending through the wall of the dispensing head defining the skirted chamber, the slit being closed by the closure member when the dispensing head is in the closed position.

The dispensing head can be mounted on the mounting member by either screw connection means or push-pull means for allowing the dispensing head to move axially between the open and closed positions by either rotating the dispensing head in relation to the mounting member or manually pulling and pushing on the dispensing head in relation to the mounting member. When the dispensing head includes applicator means, the applicator head and mounting member preferably include friction means for inhibiting movement of the applicator head from the open to the closed position by means of the push-pull means. The friction means comprises a projection on the mounting member and an engaging member on the applicator head, the engaging member contacting the projection when the applicator head is moved from the open position to the closed position, the projection causing the engaging member to flex in a direction transverse to the axial direction for passage of the engaging member over the projection when the applicator head is moved to the closed position.

The dispenser of the present invention also includes means for preventing dripping of the flowable substance therefrom after the dispensing head has been used and then placed in an upright position, the dripping preventing means comprising a radially outwardly and upwardly extending lip on the outer edge of the dispensing head. The dispenser of the present invention also includes means for preventing removal of the mounting member from the container body, the removal preventing means comprising a plurality of ratchet teeth on a lower portion of the mounting member and a plurality of lugs on the container body, the mounting member being threadedly engaged with the container body and the ratchet teeth being flexible radially outwardly for passing over radially outer surfaces of the lugs when the mounting member is rotated in one direction into engagement with the container body, the lugs having radially extending locking surfaces for engaging the ratchet teeth to prevent removal of the mounting member by rotation thereof in the opposite direction.

BRIEF DESCRIPTION OF THE DRAWINGS

The invention will be described with reference to the accompanying drawings, in which:

FIG. 4 shows a dispenser with an applicator head of the present invention in a position for treating an article with a flowable substance contained in the dispenser;

FIG. 5 shows details of one embodiment of a mounting member and an applicator head forming part of a dispenser of the present invention;

DETAILED DESCRIPTION OF THE PREFERRED EMBODIMENTS

Figure 1:
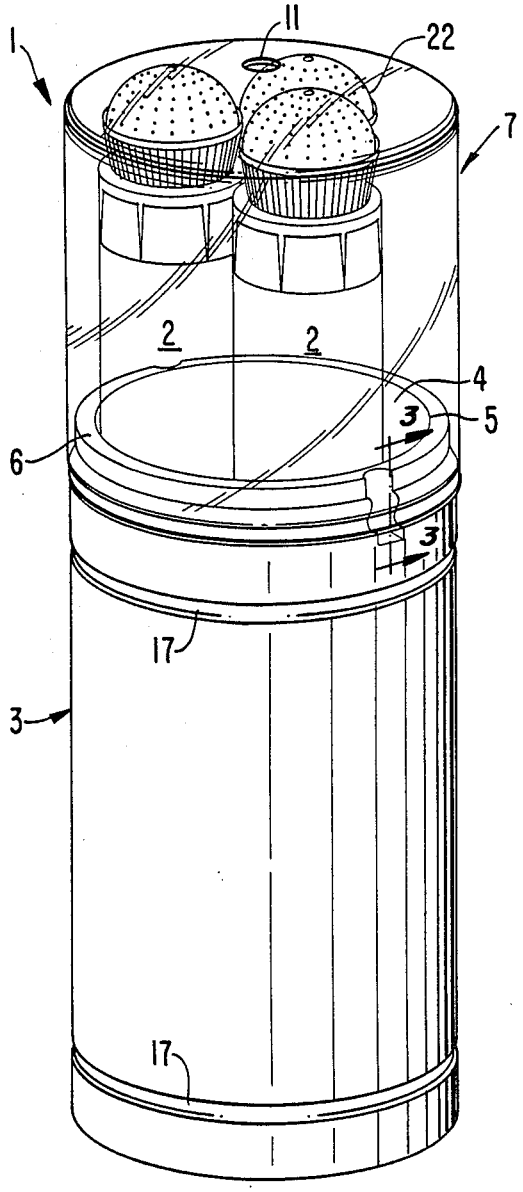
FIG. 1 shows the vented package of the present invention containing three dispensers with applicator heads according to the present invention.

FIG. 1 shows a vented package 1 of the present invention for containing a plurality of dispensers 2 according to the present invention. The vented package 1 comprises a base member 3 extending in a longitudinal direction and having a cavity 4 therein for receiving at least one of the dispensers 2, the cavity 4 forming an opening 5 in a peripheral surface of an upper end 6 of the base member 3. An overcap 7 extends in the longitudinal direction and has a lower end 8 removably fitted over the opening 5 in the base member 3. That is, the overcap 7 is removable from the opening 5 but need not be completely removable from the base member 3. Vent means is disposed on at least one of the base member 3 and the overcap 7 for preventing loss in tensile strength and crazing of the overcap 7 due to natural slight loss of product vapors through the closures of the dispensers 2 when the dispensers are contained in the vented package 1.

The overcap 7 comprises a clear plastic material having a rim 9 at the lower end 8 of the overcap 7. The base member 3 includes a ridge 10 around the upper end 6 thereof engageable with the rim 9 of the overcap 7 for removably securing the overcap 7 and the base member 3 together.

In a first embodiment, the vent means comprises at least one aperture 11 extending through the overcap 7, the aperture 11 being spaced from a portion of the overcap removably fitted over the opening 5 in the base member 3. The vent means further comprises at least one fluid passage 12 between the overcap 7 and the base member 3 although the fluid passage can comprise one or more holes extending through either the overcap 7 or the base member 3 in the vicinity of the opening 5, whereby venting of vapors having a density greater than air is effected by passage of air into the vented package through the aperture 11 and passage of vapors and air out of the vented package through the fluid passage 12 between the overcap 7 and the base member 3. It has been found that dispensers containing spot remover products inevitably produce some vapor loss through the applicator closures of the dispensers and such product vapors cause one or more of loss in tensile strength of plastic packages and discoloration and crazing of clear overcaps of such plastic packages. The present invention overcomes this problem by providing a plurality of vents in the package to eliminate this chemical degradation. The vents must be placed at suitable locations and provide a sufficient aggregate area relative to the total volume of head space within the package to result in adequate venting. Thus, with dispensers containing solvents of specific gravity greater than air, the vent holes are most advantageously placed below the level of the closure between a base member and an overcap of the package. Furthermore, since the formulas of such spot remover products are complex, it is advantageous to put at least one vent above the level of the lower base member, such as one or more vent holes in the clear plastic overcap. This arrangement permits venting of vapors having a density less than air by allowing air to pass into the package through the vent holes in the overcap to thereby carry product vapors out of the vent holes located below the applicator closures of the dispensers. Thus, the number of vent holes and the locations thereof can be determined based on the volume of head space within the package and depending upon the specific product contained in the dispensers.

Figure 2:
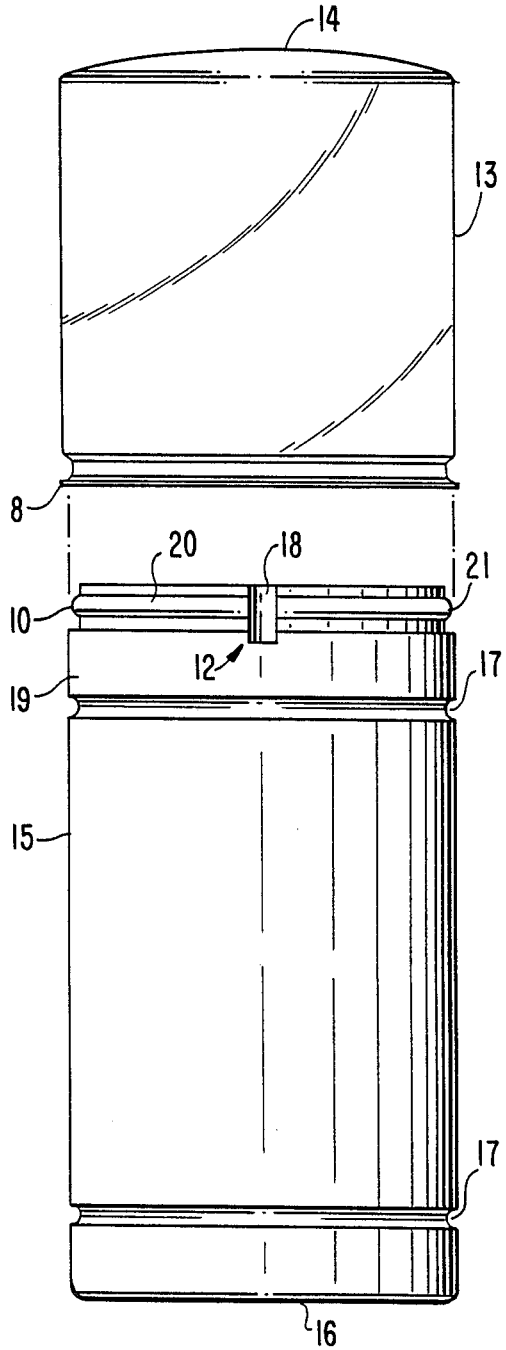
FIG. 2 shows the vented package with the overcap thereof removed from the base member thereof as well as a fluid passage on the outer periphery of the base member.
Figure 3:
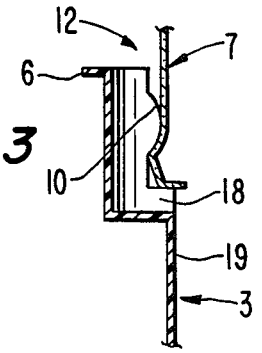
FIG. 3 shows the fluid passage taken along the lines 3—3 shown in FIG. 1.
Figure 2A:
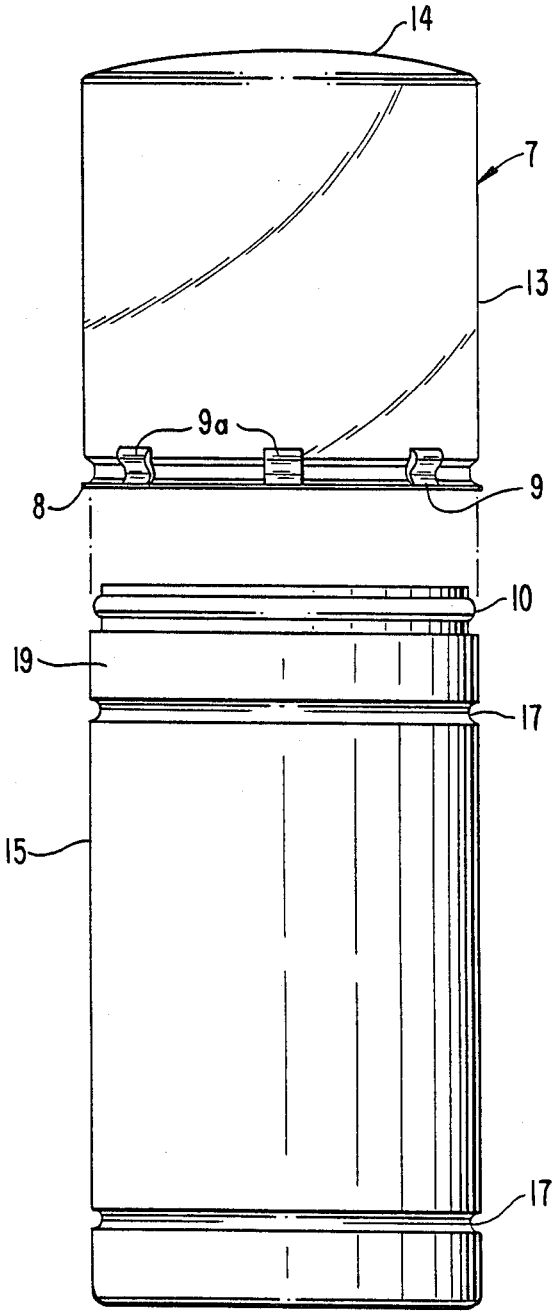
FIG. 2A shows another embodiment of the vented package wherein the fluid passage is formed by a plurality of longitudinally extending channels in the inner periphery of the overcap.
Figure 3A:
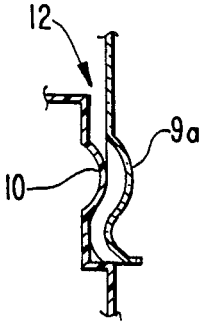
FIG. 3A shows a cross sectional view of one of the channels shown in FIG. 2A when the overcap is fitted on the base member.

In the first embodiment shown in FIGS. 1 and 2, the overcap comprises a cylindrical tubular member 13 closed at an upper end thereof by a top wall 14, the aperture 11 being disposed in the top wall 14 of the overcap 7. The base member can comprise a cylindrical tubular body 15 closed at one end thereof by a bottom wall 16, the tubular body 15 including at least one strengthening rib 17 extending circumferentially therearound. The fluid passage 12 comprises a recess 18 extending radially inwardly from an outer periphery 19 of the tubular body 15, the recess 18 extending in the longitudinal direction towards the opening 5 in the base member 3 and separating the ridge 10 on the base member 3 into first and second sections 20, 21. The recess 18 allows for passage of gasses inwardly and outwardly of the vented package 1. In the specific embodiment shown in FIG. 1, there is provided a pair of fluid passages 12. Also shown in FIG. 1 is a plurality of dispensers 2 having applicator heads 22 at one end thereof, the dispensers 2 being stored in the vented package 1 with the applicator heads 22 located within and adjacent to the top wall 14 of the overcap 7. The vented container 1 shown in FIG. 1 is specifically adapted to hold three dispensers 2.

In another embodiment of the vented package, the vent means comprises the at least one aperture 11 extending through the overcap 7, as shown in FIG. 1, and at least one channel 9*a* in an inner surface of the overcap 7 at a lower end thereof. In particular, the overcap 7 can include three pairs of diametrically opposed longitudinally extending channels 9*a* formed longitudinally in the inner surface of the rim 9 at the lower end of the overcap 7. The channels 9*a* form a space between an outer periphery of the base member 3 and the inner surface of the overcap 7 to allow passage of gasses inwardly and outwardly of the vented package 1. In addition to providing venting of the vented package 1, the channels 9*a* also perform the function of reducing stress cracking of the lower end of the overcap during removal thereof due to the sudden radially inward deformation of the lower end of the overcap as it disengages the base member.

The following description relates to the dispenser 2 of the present invention and the various embodiments thereof. In the preferred embodiment, dispenser 2 has a specific type of applicator means associated therewith as more fully described below. However, it will be understood that dispensing heads having applicator means other than that of FIG. 2 associated therewith or having no applicator means therewith are included within the scope of the invention.

The dispenser 2 comprises a container body 23 which can be rigid or squeezable for containing a flowable substance 24, a mounting member 25 and the applicator head 22. The dispenser 2 is used by inclining the container body 23 to rub the applicator head 22 on an article 26 to be treated as shown in FIG. 4. FIGS. 5–8 show one embodiment of the applicator head 22 which is actuated by a screw connection means between the applicator head 22 and the mounting member 25. As shown in FIG. 5, the mounting member 25 includes a ring seal 27 for sealing the mounting member to the container body 23.

Figure 8:
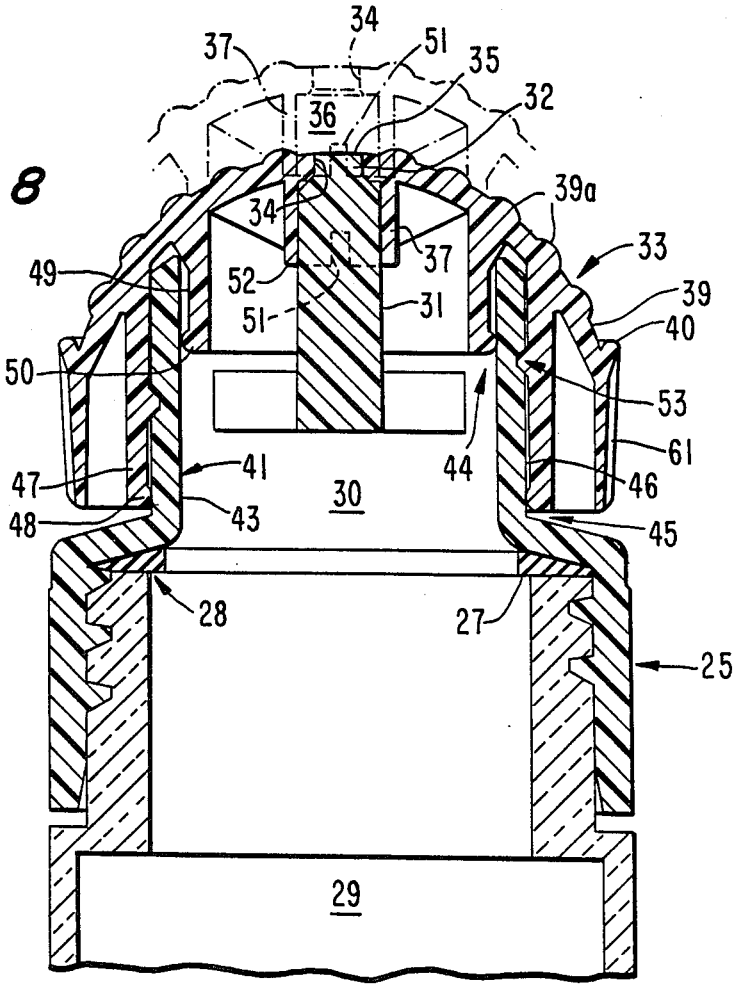
FIG. 8 shows a cross-sectional view of the applicator head and mounting member of FIG. 5 wherein the mounting member is attached to a container body and the applicator head is shown in solid lines in a closed position on the mounting member and is shown in phantom in an open position on the mounting member.

The mounting member 25 is shown in more detail in FIG. 8 wherein the mounting member 25 is shown attached to the container body 23 having an opening 28 at the top end thereof and a cavity 29 within the container body 23. The mounting member includes a flow passage 30 therethrough in fluid communication with the opening 28 in the container body 23. The mounting member includes a closure member 31 extending in an axial direction and aperture sealing means thereon for sealing a dispensing aperture in the applicator head, the aperture sealing means comprising a pin member 32 disposed on the closure member 31 extending in the axial direction away from the container body 23. While the closure member 31 is cylindrical in cross-section in the preferred embodiment, it can have other cross-sectional shapes.

The applicator head 22 is movably mounted on the mounting member 25, the applicator head 22 being movable in the axial direction towards the mounting member 25 to a closed position (as shown in solid lines in FIG. 8) and the applicator head 22 being movable in the axial direction away from the mounting member 25 to an open position (shown in dotted lines in FIG. 8). The applicator head includes applicator means 33 thereon for distributing the flowable substance 24 stored in the container body 23. The applicator head 22 also includes at least one aperture 34 and in the preferred embodiment comprises a single aperture 34 in axial alignment with the pin member 32 of the mounting member 25, the aperture 34 being sized for sealingly engaging the pin member 32 therein when the applicator head 22 is moved to the closed position. Of course, a single aperture 34 or a plurality of apertures 34 could be provided in the applicator head 22 and the closure member 31 could include aperture sealing means other than the pin member 32 for closing such apertures 34 when the applicator head is in the closed position. For instance, the upper end surface of the closure member 31 could be shaped to sealingly engage the undersurface of the applicator head 22 to thereby seal the aperture 34 or the plurality of apertures 34 in the applicator head 22. However, in the preferred embodiment, the pin member 32 has an axial end surface 35 thereof spaced from the aperture 34 when the applicator head 22 is moved to the open position. The applicator head 22 further includes a skirted chamber 36 in fluid communication with the aperture 34, the skirted chamber being defined by a radially inner surface of an axially extending wall 37 of the applicator head 22. The axially extending wall 37 has a crosssectional shape such that the inner surface thereof sealingly engages the outer surface of the closure member 31 when the applicator head 22 is in the open and closed positions whereby the flowable substance in the flow passage 30 is prevented from passing between the sealingly engaged portions of the wall 37 and the closure member 31. The skirted also includes means for controlling the rate of flow of the substance 24 from the flow passage 30 of the mounting member 25 through the wall 37 and into the skirted chamber 36 so that dripping of the flowable substance from the applicator means 33 is avoided during use thereof.

Figure 9:
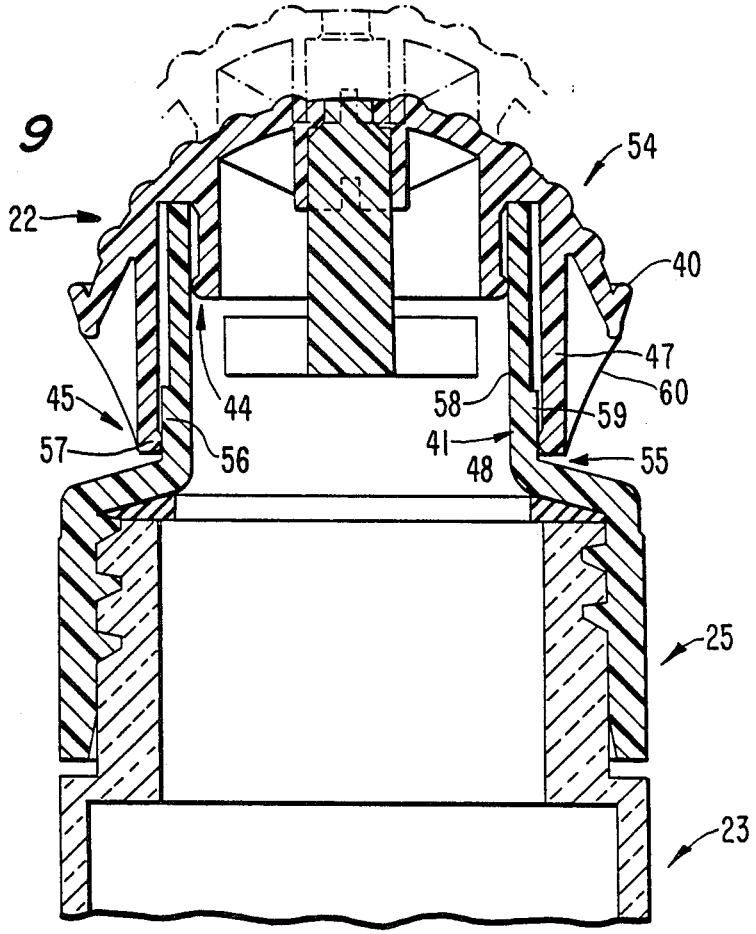
FIG. 9 shows a modification of the applicator head shown in FIG. 5.
Figure 10:
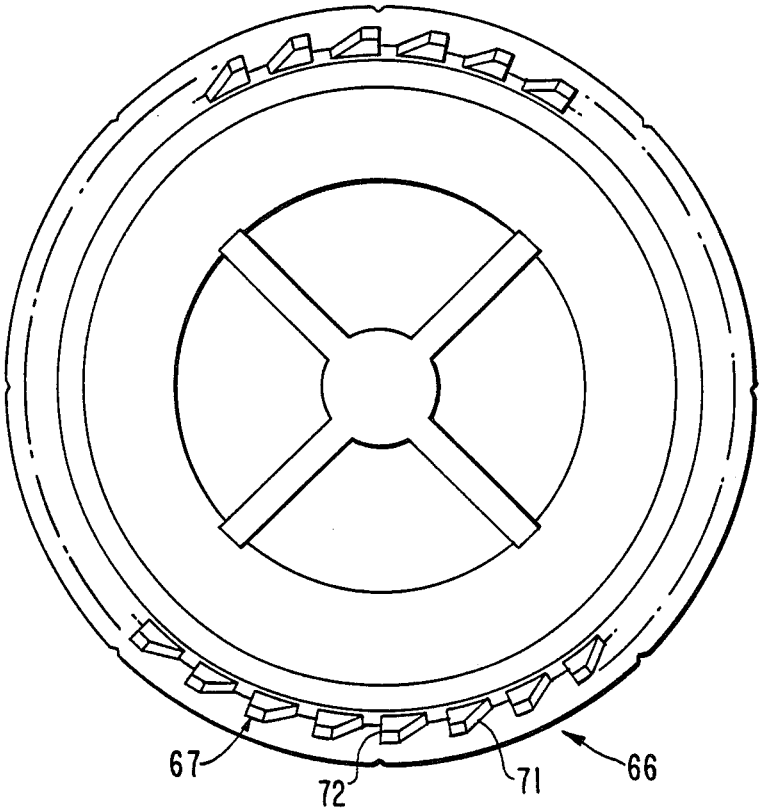
FIG. 10 shows a bottom view of a modified mounting member which includes ratchet teeth depending from a bottom edge of the mounting member.
Figure 11:
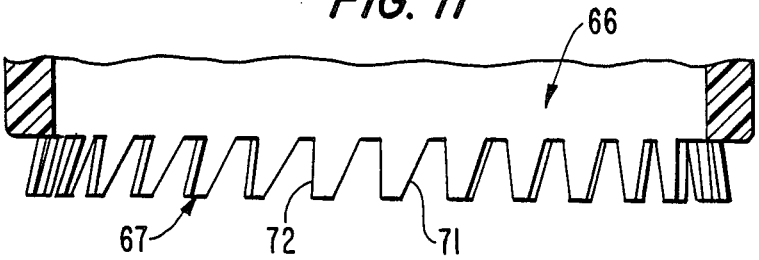
FIG. 11 shows a cross-sectional side view of the mounting member shown in FIG. 10.
Figure 12:
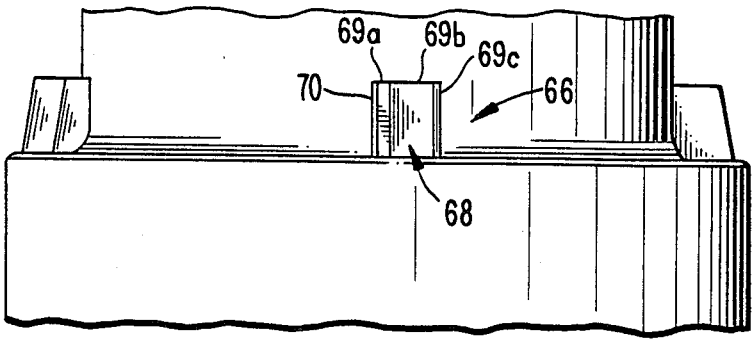
FIG. 12 shows a modified container body including lugs for engaging the ratchet teeth of the mounting member to prevent removal of the mounting member once it is attached to the container body.
Figure 13:
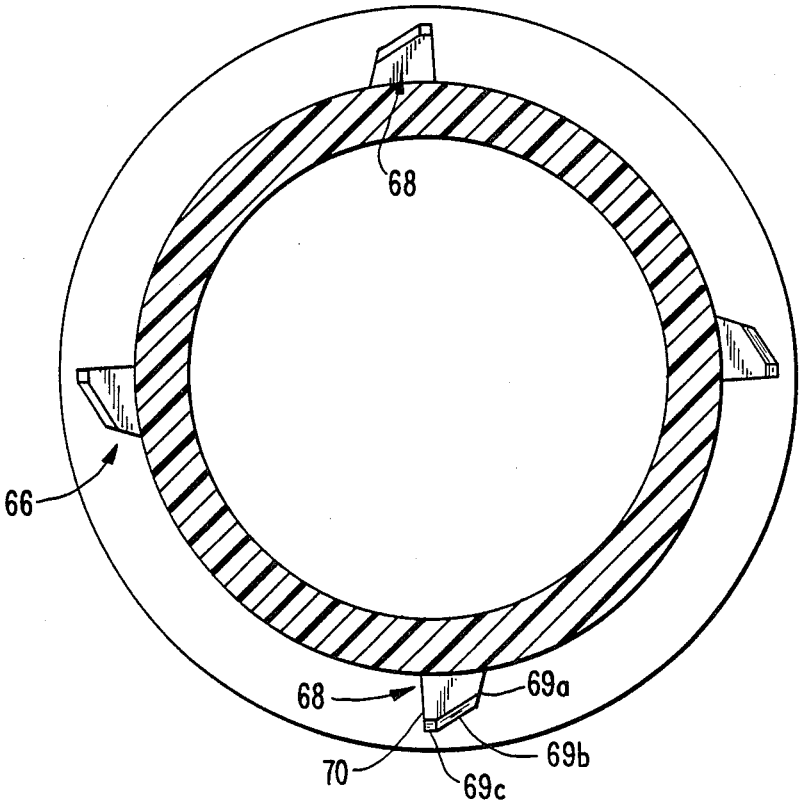
FIG. 13 shows a top cross-sectional view of the container body shown in FIG. 12.

As shown in FIGS. 4, 8 and 9, the applicator means 33 of the applicator head 22 includes a hemispherical shaped axial end surface 39 having the aperture 34 therethrough and a plurality of projections 39*a* distributed over the hemispherical surface 39. In the embodiment shown, the projections comprise round protrusions distributed in concentric rows around the aperture 34. Of course, other shaped projections and patterns of their distribution on the hemispherical surface 39 could be used. On the outer edge of the hemispherical surface 39 is a means 40 for preventing dripping of the flowable substance 24 from the applicator head 22 after the applicator head has been used and then placed in an upright position. The dripping preventing means 40 comprises a radially outwardly and upwardly extending lip, as shown in FIGS. 8 and 9. The lip 40 is thus effective to catch any remaining flowable substance on the hemispherical surface 39 which flows by gravity into the lip 40.

Figure 6:
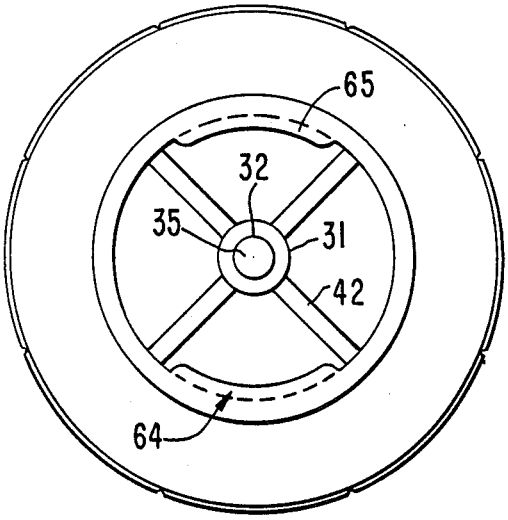
FIG. 6 shows a top view of the mounting member shown in FIG. 5.
Figure 7:
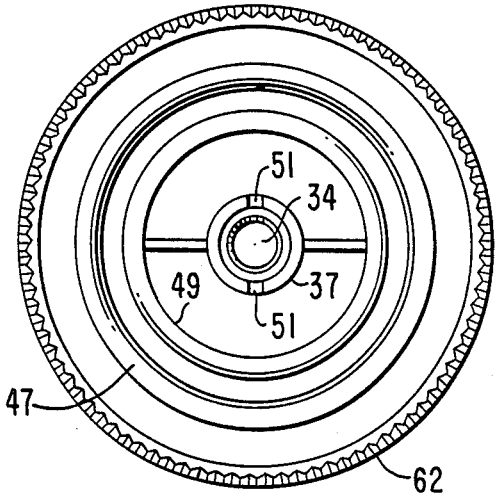
FIG. 7 shows a bottom view of the applicator head shown in FIG. 5.

The mounting member 25 includes a tubular portion 41 which extends in the axial direction away from the container body 23. The closure member 31 is attached to radially extending struts 42 which connect the closure member 31 to an inner surface 43 of the tubular portion 41. As seen in FIG. 6, four struts 42 connect the closure member 31 to the tubular portion 41. The entire mounting member 25 comprising the tubular portion 41, the struts 42, the closure member 31 and the pin member 32 are molded integrally in one piece from plastic. The applicator head 22 includes means 44 thereon for sealingly engaging the inner surface 43 of the tubular portion 41 when the applicator head 22 is in any position between and including the opened and closed positions. The applicator head 22 also includes means 45 for sealingly engaging an outer surface 46 of the tubular portion 41 when the applicator head 22 is in any position between and including the open and closed positions. As shown in FIGS. 8 and 9, the means 45 for sealingly engaging the outer surface 46 of the tubular portion 41 comprises a cylindrical sleeve 47 depending from a bottom surface of the applicator means 33 and a circumferentially extending rim 48 at the lower end of the cylindrical sleeve 47. Likewise, the means 44 for sealingly engaging the inner surface 43 of the tubular portion 41 comprises another cylindrical sleeve 49 disposed radially inward of the first cylindrical sleeve 47 and a circumferentially extending rim 50 at a lower end of the cylindrical sleeve 49. Thus, as the applicator head 22 moves between the open and closed positions, the rims 48, 50 engage the outer surface 46 and the inner surface 43 of the tubular portion 41. Also, when the applicator head 22 is in the closed position, an upper end of the tubular portion engages the underside of the applicator means 33.

The flow control means on the applicator head 22 comprises at least one opening through the axially extending wall 37 forming the skirted chamber 36. In the embodiment shown in FIG. 7, the flow control means comprises a pair of axially extending slits 51 located at the bottom end 52 of the axially extending wall 37. Each of the slits 51 has a length in the axial direction to allow flow of the flowable substance 24 from the flow passage 30 to the space defined by the skirted chamber 36 when the applicator head 22 is in the open position. However, the slits 51 are closed by the closure member 31 when the applicator head 22 is in the closed position. Thus, flow of the flowable substance 24 is prevented by the engagement of the closure member 31 with the inner surface of the axially extending wall 37 and the engagement of the pin member 32 in the aperture 34. More importantly, the slits 51 allow a slower feed of the flowable substance 24 when the dispenser 2 is in the use position shown in FIG. 4. Otherwise, if the bottom end 52 of the skirted chamber 36 was located above the closure member 31 when the applicator head 22 is in the open position, too much of the flowable substance 24 would pass out of the aperture 34 with the result that dripping of the flowable substance 24 would occur even when the container is not squeezed when a squeeze bottle is used instead of a rigid bottle. Such a situation would lead to waste of the flowable substance and dispensing of the flowable substance 24 before it was needed. The dispenser of the preferred embodiment allows the flowable substance to be dispensed when needed by squeezing the container body 23. The desired flow rate of the flowable substance 24 can be adjusted by controlling the number and sizes of the openings or slits 51 in the axially extending wall 37 of the skirted chamber 36. One advantage of the present invention is that the entire applicator head 22 including the slits 51 can be molded form plastic material in one piece. Thus, the desired flow rate of the flowable substance 24 can be reproduced with precision by forming the applicator head 22 with the slits 51 in the wall 37 in a simple molding operation.

The applicator head 22 can be mounted on the mounting member by a screw connection means 53 as shown in FIG. 8 or a push-pull means 54, as shown in FIG. 9. The screw connection means 53 allows the applicator head to move axially between the open and closed positions by rotating the applicator head 22 in relation to the mounting member 25. On the other hand, the push-pull means 54 allows the applicator head 22 to move axially between the open and closed positions by manually pulling and pushing on the applicator head 22 in relation to the mounting member 25. The screw connection means 53 comprises mutually engaging threads on the inner surface of the cylindrical sleeve 47 and the outer surface 46 of the tubular portion 41.

In the embodiment shown in FIG. 9, the applicator head 22 and the mounting member 25 include friction means 55 for inhibiting movement of the applicator head 22 from the open position to the closed position during use of the applicator head 22 to apply the flowable substance 24 on an article 26. The friction means 55 comprises a projection 56 on the mounting member 25 and an engaging member 57 on the applicator head 22. The engaging member 57 contacts the projection 56 when the applicator head is moved from the open position towards the closed position, the projection 56 causing the engaging member 57 to flex in a direction transverse to the axial direction for passage of the engaging member over the projection 56 when the applicator head 22 is moved to the closed position. In particular, the tubular portion 41 is comprised of a cylindrical wall 58 having a larger diameter section 59 at a lower end thereof, the section 59 comprising the projection 56 and the means 45 for sealingly engaging the outer surface 46 of the tubular portion 41 comprises the cylindrical sleeve 47 depending from the underside of the applicator means 33 and the circumferentially extending rim 48 at the lower end of the cylindrical sleeve 47, the rim 48 comprising the engaging member 57. To facilitate pushing and pulling on the applicator head 22, the lip 40 is connected to the cylindrical sleeve 47 by a plurality of vertically extending webs 60 therebetween, the webs 60 being spaced apart circumferentially around the applicator head 22 to allow better gripping of the applicator head 22 beneath the lip 40. The applicator 22 actuated by the screw connection means 53, on the other hand, does not include the webs 60 but rather a cylindrical wall 61 is provided depending from the lip 40, the wall 61 having vertically extending grooves 62 thereon for rotation thereof.

The applicator head 22 shown in FIGS. 8 and 9 also includes means 64 for resisting removal of the applicator head 22 from the mounting member 25, the resisting means 64 comprising the cylindrical sleeve 49 and the rim 50 at the lower end thereof. The resisting means 64 also includes an abutment 65 on the upper end of the tubular portion 41, the abutment 65 extending transversely to the axial direction, as shown in FIG. 6. In the embodiment shown in FIG. 6, a pair of opposed abutments 65 are provided in the space between adjacent struts 42, the abutments 65 extending circumferentially no further than the joint between the struts 42 and the inner surface of the tubular portion 41 for allowing easy removal of the mounting member 25 from a mold after the mounting member 25 is molded in one piece from plastic. The abutment 65 engages the rim 50 when the applicator head 22 is in the open position to thereby resist removal of the applicator head 22 from the mounting member 25.

Another embodiment of the present invention is shown in FIGS. 10–13 wherein the mounting member 25 and the container body 23 include means 66 for preventing removal of the mounting member 25 from the container body 23. The removal preventing means 66 comprises a plurality of ratchet teeth 67 depending from the lower portion of the mounting member 25 and a plurality of lugs 68 on the container body 23. As shown in FIG. 9, the mounting member 25 is threadedly engaged with the container body 23 and the ratchet teeth 67 are flexible radially outwardly for passing over radially outer surfaces 69 of the lugs when the mounting member 25 is rotated in one direction into engagement with the container body 23. The lugs 68 have radially extending locking surfaces 70 for preventing removal of the mounting member 25 by rotation thereof in the opposite direction. The ratchet teeth 67 include forward surfaces 71 and rear surfaces 72, the forward surfaces 71 being inclined to the axial direction and the rear surfaces being parallel to the axial direction. Upon rotation of the mounting member 25 into threaded engagement with the container body 23, the forward surfaces 71 pass over the outer surfaces 69 of the lugs 68 such that the ratchet teeth 67 flex radially outwardly and the ratchet teeth 67 flex radially inwardly once the rear edges 72 thereof pass over the radially extending locking surfaces 70 of the lugs 68. It can be seen in FIGS. 12 and 13 that each of the lugs 68 include three radially outer surfaces, the first surface **69*a* extending from the outer surface of the container body 23 at a steeper angle than the second surface 69*b*, the second surface 69*b* being between the first surface 69*a* and the third surface 69*c* which is substantially perpendicular to the locking surface 70. From FIG. 13, it can be seen that the second surface 69*b* and third surface 69*c* are inclined to the axial direction at a suitable angle, such as about 10 degrees. The first surface 69*a* can be inclined to the locking surface at an angle of about 15 degrees and the second surface 69*b* can be inclined to the locking surface at an angle of about 55 degrees. The locking surface 70 can also form an angle with the third surface 69*c* slightly larger than 90 degrees, such as 95 degrees. Furthermore, the ratchet teeth 67** can be inclined to the axial direction such that the lower ends of the ratchet teeth are inclined outwardly at an angle of about 10 degrees to the upper ends thereof.

Although the present invention has been described with reference to the foregoing embodiments, it will be apparent to those skilled in the art that numerous variations can be made in such preferred embodiments without departing from the invention or the scope of the appended claims.

We claim:

1. A dispenser comprising:

a container body having an opening at one end thereof and a cavity therein in fluid communication with said opening;

a mounting member detachably mounted to said container body at said one end of said container body, said mounting member having a flow passage therethrough in fluid communication with said opening in said container body, said mounting member including a closure member extending in an axial direction away from said container body;

a dispensing head movably mounted on said mounting member, said dispensing head being movable in said axial direction towards said mounting member to a closed position and movable in said axial direction away from said mounting member to an open position, said dispensing head having at least one aperture therein for dispensing a flowable substance stored in said container body, said closure member including aperture sealing means for sealing said at least one aperture when said dispensing head is in said closed position, said dispersing head further including an axially extending wall defining a skirted chamber in fluid communication with said at least one aperture, said axially extending wall of said dispensing head having a radially inner surface sealingly engaging an outer periphery of said closure member when said dispensing head is in positions between and including said open and closed positions such that the flowable substance in the flow passage is prevented from passing between the sealingly engaged portions of the inner surface of the wall and the outer periphery of the closure member, said wall having a radially outer surface in fluid communication with said flow passage of said mounting member, and said wall having a free end defined by a terminal edge extending between said radially inner and outer surfaces, and said skirted chamber including flow controlling means for controlling flow of the flowable substance from said flow passage of the mounting member into said skirted chamber when said dispensing head is in the open position so that excess dripping of the flowable substance from the dispensing head is avoided during use thereof, said flow controlling means comprising at least one contiguous elongated slot extending through said wall and open at said terminal edge thereof, the entire said at least one slot extending over the outer periphery of said closure member when said dispensing head is in the closed position.

2. The dispenser of claim 1, wherein said dispensing head comprises an applicator head movably mounted on said mounting member, said applicator head being movable in said axial direction towards said mounting member to a closed position and movable in said axial direction away from said mounting member to an open position, said applicator head having applicator means thereon for distributing a flowable substance stored in said container body over an article to be treated.

3. The dispenser of claim 2, wherein said applicator means includes a hemispherical shaped axial end surface on said applicator head with said at least one aperture therethrough, said applicator means further comprising a plurality of projections on said hemispherical surface.

4. The dispenser of claim 2, wherein said applicator head and said mounting member include push-pull means for allowing said applicator head to move axially between said open and closed positions by manually pulling and pushing on said applicator head in relation to said mounting member.

5. The dispenser of claim 4, wherein said applicator head and said mounting member include friction means for inhibiting movement of said applicator head from said open position to said closed position during use of said applicator head to apply the flowable substance on an article.

6. The dispenser of claim 5, wherein said friction means comprises a projection on said mounting member and an engaging member on said applicator head, said engaging member contacting said projection when said applicator head is moved from said open position towards said closed position, said projection causing said engaging member to flex in a direction transverse to said axial direction for passage of said engaging member over said projection when said applicator head is moved to said closed position.

7. The dispenser of claim 6, wherein said mounting member includes a tubular portion extending in said axial direction, said closure member being disposed radially inward of an inner surface of said tubular portion, said applicator head including means thereon for sealingly engaging said inner surface of said tubular portion when said applicator head is in any position between and including said open and closed positions, said applicator head further including means for sealingly engaging an outer surface of said tubular portion when said applicator head is in any position between and including said open and closed positions, said tubular portion comprising a cylindrical wall having a section thereof of larger diameter than the remainder of said cylindrical wall, said section comprising said projection on said mounting member, said means for sealingly engaging said outer surface of said tubular portion comprising a cylindrical sleeve depending from a bottom surface of said applicator head, said cylindrical sleeve having a radially inwardly extending rim at a lower end thereof, said rim sealingly engaging said outer surface of said tubular portion and comprising said engaging member on said applicator head.

8. The dispenser of claim 7, wherein said means for sealingly engaging said inner surface of said tubular portion comprises an additional cylindrical sleeve depending from said bottom surface of said applicator head, said additional cylindrical sleeve being disposed radially inwardly from said inner surface of said tubular portion and having a radially outwardly extending rim at a lower end thereof, said radially outwardly extending rim sealingly engaging said inner surface of said tubular portion.

9. The dispenser of claim 2, further comprising means on said applicator head for preventing dripping of the flowable substance therefrom after said applicator head has been used and then placed in an upright position, said dripping preventing means comprising a radially outwardly and upwardly extending lip on said applicator head.

10. The dispenser of claim 1, wherein said aperture sealing means comprises a pin member disposed on said closure member, said pin member extending in said axial direction away from said container body, said at least one aperture in said dispensing head comprising a single aperture in axial alignment with said pin member on said mounting member, said aperture being sized for sealingly engaging said pin member therein when said dispensing head is moved to said closed position, said pin member having an axial end surface thereof spaced from said aperture when said dispensing head is moved to said open position.

11. The dispenser of claim 1, wherein said mounting member includes a tubular portion extending in said axial direction away from said container body, said closure member being disposed radially inward of an inner surface of said tubular portion, said dispensing head including means thereon for sealingly engaging said inner surface of said tubular portion when said dispensing head is in any position between and including said open and closed positions.

12. The dispenser of claim 11, wherein said dispensing head includes means for sealingly engaging an outer surface of said tubular portion when said dispensing head is in any position between and including said open and closed positions.

13. The dispenser of claim 12, wherein said means for sealingly engaging said outer surface of said tubular portion comprises a cylindrical sleeve depending from a bottom surface of said dispensing head, said cylindrical sleeve having a radially inwardly extending rim at a lower end thereof, said radially inwardly extending rim sealingly engaging said outer surface of said tubular portion.

14. The dispenser of claim 12, wherein said means for sealingly engaging said outer and inner surfaces of said tubular portion comprises first and second cylindrical sleeves depending from a bottom surface of said dispensing head, said first cylindrical sleeve having a radially inwardly extending rim at a lower end thereof, said radially inwardly extending rim sealingly engaging said outer surface of said tubular portion, said second cylindrical sleeve being disposed radially inwardly of said first cylindrical sleeve and having a radially outwardly extending rim at a lower end thereof, said radially outwardly extending rim sealingly engaging said inner surface of said tubular portion.

15. The dispenser of claim 1, wherein said dispensing head and said mounting member include screw connection means for allowing said dispensing head to move axially between said open and closed positions by rotating said dispensing head in relation to said mounting member.

16. The dispenser of claim 1, further comprising means for preventing removal of said mounting member from said container body, said removal preventing means comprising a plurality of ratchet teeth on a lower portion of said mounting member and a plurality of lugs on said container body, said mounting member being threadedly engaged with said container body and said ratchet teeth being flexible radially outwardly for passing over radially outer surfaces of said lugs when said mounting member is rotated in one direction into engagement with said container body, said lugs having radially extending locking surfaces for engaging rear surfaces of said ratchet teeth to prevent removal of said mounting member by rotation thereof in the opposite direction.

17. The dispenser of claim 1, wherein said dispensing head and said mounting member include means for resisting removal of said dispensing head from said mounting member, said resisting means comprising a sleeve on said dispensing head extending towards said mounting member, said sleeve including a rim extending transversely to said axial direction, said resisting means further comprising a tubular portion on said mounting member, said tubular portion extending in said axial direction towards said dispensing head, said tubular portion including an abutment extending transversely to said axial direction, said abutment engaging said rim when said dispensing head is in said open position to thereby resist removal of said dispensing head from said mounting member.

18. The dispenser of claim 17, wherein said sleeve is disposed radially inwardly of an inner surface of said tubular portion, said rim being at a lower end of said sleeve and extending radially outwardly thereof, said abutment being located on said inner surface of said tubular portion at an upper end thereof.

19. The dispenser of claim 1, wherein said container body comprises a squeeze bottle for dispensing a flowable substance therefrom by manually squeezing said bottle.

* * * * *